United States Patent [19]

Silverman

[11] 4,284,382

[45] Aug. 18, 1981

[54] OFF-LOADER

[75] Inventor: Seymour Silverman, New York, N.Y.

[73] Assignee: Silverman Machines, New York, N.Y.

[21] Appl. No.: 42,978

[22] Filed: May 29, 1979

[51] Int. Cl.[3] ..... B65H 29/10

[52] U.S. Cl. ..... 414/76; 271/85; 414/20; 414/97; 414/753; 414/900

[58] Field of Search ..... 414/20, 65, 69, 76, 414/82, 86, 97, 753, 900; 271/82, 84, 85, 204, 206

[56] References Cited

U.S. PATENT DOCUMENTS

| | | | |
|---|---|---|---|
| 1,940,154 | 12/1933 | Sylva | 271/85 |
| 3,046,010 | 7/1962 | Schneider | 271/219 |
| 3,662,901 | 5/1972 | Brintley | 414/900 X |
| 3,729,190 | 4/1973 | Harris et al. | 271/85 |
| 3,747,920 | 7/1973 | Linkus | 271/85 |
| 3,891,204 | 6/1975 | Mager | 271/85 |
| 3,901,392 | 8/1975 | Streckert | 414/900 X |
| 3,921,820 | 11/1975 | Crockett | 414/753 |
| 3,951,400 | 4/1976 | Blessing et al. | 271/85 |
| 4,2 03,590 | 5/1980 | Blessing | 271/265 |

FOREIGN PATENT DOCUMENTS

| | | | |
|---|---|---|---|
| 52-11573 | 1/1977 | Japan | 271/84 |

*Primary Examiner*—Leslie J. Paperner
*Attorney, Agent, or Firm*—James & Franklin

[57] ABSTRACT

An expandable modular housing is adjustably positioned with its open entrance side adjacent the output end of a conveyor feeding one or more lanes of parts. Affixed to the undersurface of the top of the housing are a pair of normally open jaws aligned with each lane. Each pair of jaws is movable along guide rails, in the direction of conveyor movement, between a first position where the jaws are opened and situated to receive a part from the conveyor, the presence of which is sensed to close the jaws and cause movement of the jaws through a second position, wherein the jaws are caused to open to release the part, to a third position, spaced from the second position, along the same direction. Below the path of movement of each pair of jaws is a position adjustable stacking table having interchangeable surfaces of different shapes onto which each part is placed in succession. The second position of the jaws is adjustable with respect to the first position to accommodate different length parts. The mechanism is adjustable to permit off-loading of parts of a large variety of different sizes, styles and materials from conveyors of different dimensions. In addition, the mechanism can be altered to accommodate different numbers of lanes of parts simultaneously.

13 Claims, 8 Drawing Figures

OFF-LOADER

BACKGROUND OF THE INVENTION

The present invention relates to an off-loader and, more particularly, to an off-loader which is adjustable to permit stacking of parts of a wide variety of different sizes, styles and materials, simultaneously, from a variable number of parallel lanes of parts and which can be used in conjunction with conveyors of different dimensions.

Basically, an off-loader is a materials handling device which takes a number of parts fed to it in succession from one surface, for instance a conveyor, and places the parts in a stack on a second surface, such as a stacking table or the like. Such a device is normally used at the output of an assembly line operation wherein partially or fully completed parts travel down a conveyor. The parts are taken off the conveyor in succession and placed on a table or the like for temporary storage, transfer to another assembly line station for further operations, or transfer to a packing station to permit packaging for shipment.

In the past, operations such as off-loading, which require simple repetitive movements, have been performed by unskilled or semi-skilled workers. However, rising labor costs have put increasing pressure on manufacturers to automate portions of assembly lines as much as is practical because the cost of capital equipment, spread over the lifetime of the machinery, is less than the aggregate costs associated with the labor required to perform the same operation over the same period.

Materials handling equipment can do things which workers cannot. Such equipment can be designed to work faster and more accurately than workers, move heavier loads than a worker can and perform repetitive operations without becoming bored or tired. Machines do not become ill or pregnant, require no fringe benefits, and do not unionize for collective bargaining purposes. Such machines can be specifically designed to perform well defined operations efficiently and productively.

However, machines of this type also have a major disadvantage. A machine can be designed to do a specific well defined task highly efficiently, but if the task changes, albeit slightly, the machine cannot adjust to this change and must be mechanically altered each time the task changes. Human beings, on the other hand, can modify their behavioral patterns to suit the situation. Thus, in certain instances, human labor has a great advantage over mechanized systems—versatility. Because conventional equipment lacks versatility, it has been difficult to produce equipment to automate certain operations in some industries because of wide variations in production techniques between different manufacturers and variations in a particular manufacturer's production system as different types of products are produced on the same line.

While it is recognized that versatility is required if a machinery manufacturer is to produce a machine with widespread application, building versatility into materials handling equipment is costly. In fact, building versatility into equipment can be so costly that the capital expenditure required for the equipment may be greater than the cost of the unskilled labor which can perform the same function, thereby contra-indicating the use of the machine.

While different industries demand different degrees of versatility in materials handling equipment, one type of industry, the clothing and softgoods manufacturing industry, has been particularly resistant to the widespread use of automated equipment. The reason for this resistance is clear when the nature of this industry is considered. Manufacturers in this industry tend to produce a single product, or a line of closely related products. For example, some manufacturers manufacture only men's shirts, while others manufacture only men's suits or ladies' outerwear. Thus, each manufacturer has a different type of production system suited to the particular product, or products, which it manufactures. For this reason, it is difficult for a materials handling equipment manufacturer to produce a single piece of equipment which can be readily adapted to the large number of different production systems which are used in the manufacture of the different types of clothing. In addition, each manufacturer must be able to produce parts, although similar in nature, in a large variety of different sizes, styles and fabrics. Thus, a piece of materials handling equipment which is purchased by such a manufacturer must be capable of operating successfully for products of a wide variety of different sizes, styles and fabrics without requiring substantial mechanical modification. Moreover, the equipment must be able to accommodate a variable number of different parallel lanes of parts simultaneously.

Theoretically, the operation of a piece of materials handling equipment, such as an off-loader, is quite simple: grasp parts in succession from a conveyor; move the parts from the conveyor to a different location and place the parts on a stack at the second location. However, in practice, to produce a commercially successful off-loader, the equipment manufacturer must produce a machine which is versatile enough to find industry-wide application in a wide variety of different production systems making different types of products, and, in addition, must be versatile enough such that a particular manufacturer can modify the machine to accommodate parts of different sizes, styles and fabrics and variable numbers of lanes of parts in an inexpensive and relatively rapid fashion.

It is, therefore, a prime object of the present invention to provide an off-loader which is versatile enough to permit widespread application in the clothing and softgoods industries.

It is a second object of the present invention to provide an off-loader which is versatile enough to be utilized with parts of a wide variety of different sizes, shapes and fabrics.

It is a third object of the present invention to provide an off-loader which is versatile enough to be used in conjunction with a wide variety of other materials handling equipment such as conveyors of different dimensions, or the like.

It is a fourth object of the present invention to provide an off-loader which is versatile enough to simultaneously accommodate variable numbers of parallel lanes of parts on the same or adjacent conveyors.

It is a fifth object of the present invention to provide an off-loader which is versatile enough to permit stacking of parts on interchangeable surfaces of different dimensions.

It is another object of the present invention to provide an off-loader which is designed for inexpensive modification to meet the needs of a particular purchaser.

It is still a further object of the present invention to provide an off-loader which can be adjusted by the purchaser, in an easy and quick fashion, to accommodate parts of different sizes, styles and fabrics and to permit same to accommodate variable numbers of lanes of parts.

It is still another object of the present invention to provide an off-loader which comprises relatively simple parts which function reliably together.

It is still a further object of the present invention to provide an off-loader which is relatively inexpensive to manufacture, modify and maintain.

In accordance with the present invention, apparatus is provided for off-loading a part from a conveyor or the like. The apparatus comprises a support and a part grabbing means. Means are provided for moving the grabbing means relative to the support in a given direction, from a first position, wherein the grabbing means grabs the part, through a second position, wherein the grabbing means releases the part, to a third position which is spaced from the second position along the same direction. Means are provided for adjusting the distance between the first and second positions so as to permit parts of a variety of different lengths to be accommodated.

The moving means comprises a means for mounting the grabbing means on the support and means for adjusting the position of the mounting means relative to the support. The support is preferably in the form of a housing or enclosure having an open entrance side designed to be situated adjacent the output end of a conveyor, along which one or more parallel lanes of parts travel.

A grabbing means and associated hardware is provided in alignment with each lane. The grabbing means is mounted to the undersurface of the top of the housing in a manner which permits the location of the grabbing means to be varied vertically with respect to the conveyor and horizontally in a direction substantially transverse to conveyor movement. In this manner, the height and position of the grabbing means can be varied to accommodate conveyors of different dimensions and several grabbing means can be utilized in side-by-side fashion within the same housing in order to off-load different numbers of parallel lanes of parts, either on one conveyor or on adjacent conveyors.

The moving means preferably comprises an assembly including guide means and a cylinder operably connected to the grabbing means for moving the latter along the guide means. The adjusting means comprises means for adjusting the position of the assembly relative to the support, as well as means for adjusting the position of the support relative to the conveyor.

Within the housing, a stacking surface is provided for each lane of parts which are off-loaded. The parts are stacked in succession on the stacking surface, which is at least partially located between the first and second positions of the grabbing means. The stacking surface is located below the path of movement of the grabbing means. In this manner, when the grabbing means grabs the leading end of the part in its first position, and then moves towards the third position, the free end of the part hangs from the grabbing means and is deposited on the stacking surface as the leading end is moved to the second position and released.

In order to prevent the free end of the part from contacting the previously stacked parts at a point too near the beginning of the path of movement of the grabbing means and thus causing alteration of the position of the part which is on the top of the stack, a means for temporarily supporting the free end of the part, until the grabbing means has traveled for a preset distance, is provided. This temporary support means is preferably in the form of a bar mounted transverse to the path of movement of the part a few inches below the first position of the grabbing means. After the part has been grabbed and the grabbing means begins to move away from the conveyor, the free end of the part, instead of hanging freely, is temporarily supported by the transverse bar until the grabbing means has moved along its path a distance which is somewhat less than the length of the part. The free end of the part is then no longer supported and is draped on the stack at a point close to its final position. Shortly thereafter, the leading end of the part is released by the grabbing means. In this manner, the parts, as same are put in succession on the top of the stack, will not vary the position of the parts previously situated on the stack.

Means are provided for adjusting the height of the stacking surface relative to the path of movement of the parts. In addition, means are provided for adjusting the angular position of the surface relative to the direction of conveyor movement and for accommodating stacking surfaces of different shapes and dimensions. Furthermore, the position of the stacking surface with respect to the housing, both in the direction of conveyor movement and in the direction transverse thereto, can be adjusted. This latter feature may be accomplished by mounting the stacking surface on rollers or the like. This configuration has the additional advantage of permitting the stacking surface, with the parts stacked thereon, to be rolled out of the housing and be replaced with an empty stacking surface.

The grabbing means comprises a pair of normally open jaws. A part sensing means is provided, as is a means responsive to the part sensing means for closing the jaws when a part is sensed to be between the jaws. The sensing means comprises a scanner including light generating means and photo-sensitive signal generating means, the latter being adapted to actuate jaw closing means and the moving means when the light path between the light generating means and the signal generating means is interrupted by the presence of the part between the jaws.

The scanner is preferably located above the jaws. The bottom jaw has a reflective surface thereon. Light from the light generating means travels from above the jaws to the reflecting surface on the bottom jaw and back to the photo-sensitive signal generating means. When the jaws are open and in the first position, the light path from the light generating means, to the reflective surface on the bottom jaw and then to the photo-sensitive signal generating means, is complete until interrupted by the presence of a part between the jaws. It is therefore necessary that the top jaw itself not interrupt the light path, falsely signalling the presence of a part between the jaws. In order to prevent the top jaw from inadvertently interrupting the light path, the top jaw is provided with a cutout portion adapted to be aligned with the light path. The light beam travels within the cutout portion, Part sensing may also be accomplished with a microswitch when the objects to be stacked are transparent or "open" such as netting.

In certain instances, the parts to be off-loaded are quite long. In fact, the part may be longer than the conveyor. In this case, the leading end of the part may be pulled by the grabbing means before the trailing end is freed from the work station feeding the conveyor. This situation obviously would create a problem. In order to overcome this problem, a delay means may be associated with the moving means for delaying the actuation of the moving means for a predetermined time interval after the light path is interrupted by the part. Thus, when the sensing means senses the presence of the leading end of a part between the jaws, the jaws are closed but actuation of the jaw moving means from the first position is delayed for a predetermined time during which the trailing end of the part is freed from the work station. This enables even very long parts to be stacked.

To the accomplishment of the above, and to such other objects as may hereinafter appear, the present invention relates to an off-loader as described in the following specification and recited in the annexed claims, taken together with the accompanying drawings, wherein like numerals refer to like parts, and in which:

Figure 1:
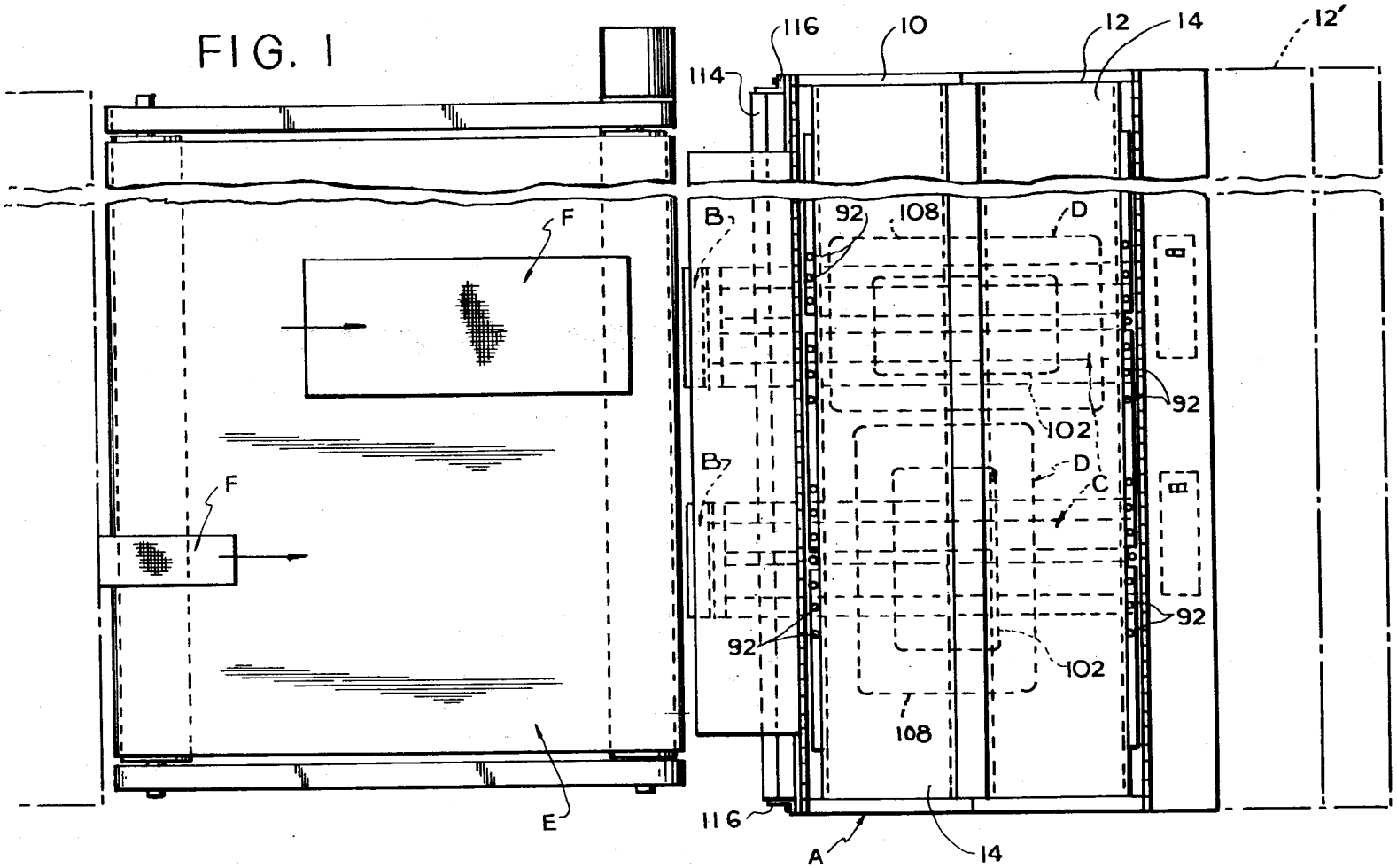
FIG. 1 is an elevated plan view of the top of the off-loader of the present invention, and a conveyor utilized in conjunction therewith.
Figure 2:
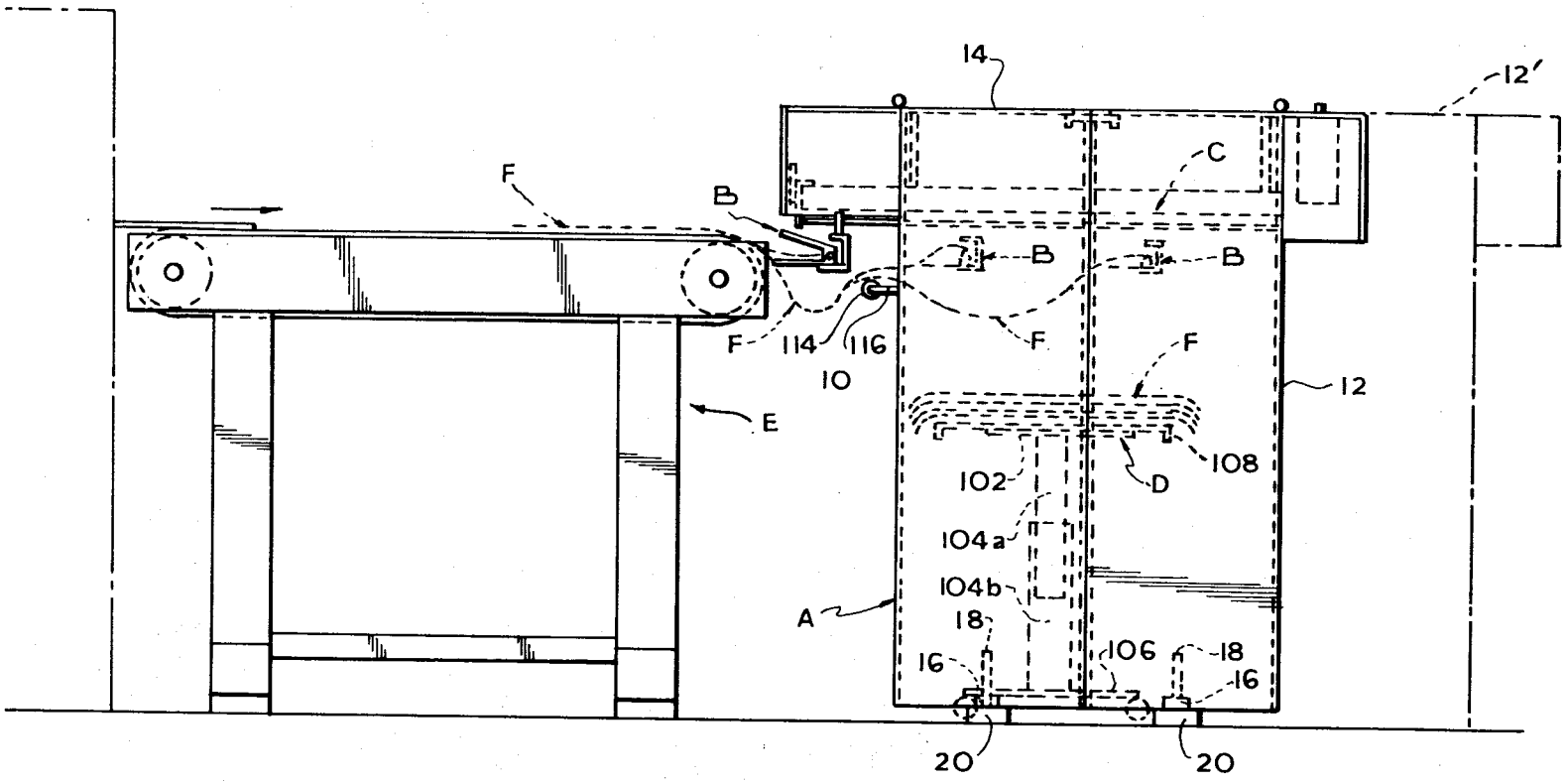
FIG. 2 is a side view of the apparatus shown in FIG. 1, showing sequential views of the grabbing means as it is moved to grab and stack a part.

As depicted in FIGS. 1 and 2, the off-loader of the present invention comprises a support or housing, generally designated A, below which is situated grabbing means, generally designated B, one of which is provided for each lane of parts to be situated. Each grabbing means B is affixed to the undersurface of the top portion of housing A by a mounting assembly, generally designated C. Mounting assembly C includes the mechanism which moves and guides grabbing means B, and the structure which supports same on the housing. Located below the path of movement of each grabbing means B is a stacking table, generally designated D. Housing A is designed to be situated adjacent the output end of a conveyor or the like, generally designated E, along which one or more lanes of parts, generally designated F, are moved.

A part F, which may be a single layer or multiple fuse layers of fabric or the like, travels along the surface of conveyor E until the leading end thereof is inserted into the grabbing means B which is located in its first position adjacent the output end of the conveyor. Grabbing means B is caused to grab the leading end of the part F and, thereafter, is moved, by means in mounting assembly C, along housing A in the direction of conveyor movement. As the grabbing means B is moved from its first position to its second position, the trailing end of part F is pulled off conveyor E and gravity causes same to hang from the grabbing means, first on a support bar, and then onto the top of the stack on stacking table D. When the grabbing means B reaches its second position, it opens to release the leading end of the part. The leading end of the part then drops towards the surface of the stacking table D and the grabbing means continues its movement, in the same direction, until it reaches a third position wherein its direction of movement is reversed, returning it to its first position in order to grab the next part F from conveyor E. Parts are stacked on stacking table D in succession in this manner until the stacking table is full. At this time, the table with the parts stacked thereon may be removed and an empty stacking table is substituted therefor. The parts may be removed from the table and the same table returned to its original position. Access to the tables may be from the rear or either side, as large apertures for this purpose exist at either side of the housing.

Housing A is basically a box-like enclosure formed of a variable number of modular sections, only two of which, 10 and 12, are illustrated. Housing A has a modular design to permit same to be extended lengthwise, such that it can be expanded to accommodate longer parts requiring a longer path of travel for grabbing means B. This feature is illustrated in the FIGS. 1 and 2 by showing a second position for rear section 12 in phantom and designating same as 12'. When the length of housing A is expanded, by adding an intermediate section, the rear section 12 is in the 12' position, and the intermediate module section (not shown) is inserted between the front section 12 and the rear section 12'. As many intermediate sections as are required for a particular application can be inserted between the rear and front sections. In this manner, the equipment manufacturer can easily design the off-loader to accommodate the needs of a particular purchaser by simply adding the required number of modular sections to the housing when same is constructed. Of course, as the housing is extended lengthwise, so is the grabbing means mounting assembly C, such that the path of movement of the grabbing means B is extended accordingly.

As best seen in FIG. 1, the embodiment of the present invention illustrated in the drawings is set up for the off-loading of two parallel lanes of parts F simultaneously. Thus, two sets of grabbing means B, mounting assemblies C and stacking tables D are provided. It is, however, to be understood that the present invention is not limited to the use of two off-loading mechanisms situated side-by-side within a single housing. On the contrary, it should be appreciated that the present invention may incorporate as many off-loading mechanisms within the housing as are required for a particular application. Thus, in some instances, only a single off-loading mechanism is provided while, in other instances, as many as three or four side-by-side off-loading mechanisms may be utilized, simply by extending the width of housing A during construction thereof, if necessary. In this manner, the off-loader of the present invention may be designed to accommodate a variable number of lanes of parts F simultaneously by simply duplicating the parts thereof.

The side of front section 10, hereinafter referred to as the "entrance" side, situated adjacent conveyor E, is open. This permits parts F to be moved from the conveyor to the stacking table without interference from the housing A. In a similar manner, the side of rear section 12, facing away from conveyor E, hereinafter referred to as the "output" side, is also open or openable to permit access to the stacking tables D such that same can be withdrawn from housing A when filled. Front section 10 and rear section 12 also have apertures to permit removal of the stack from either side of the housing.

Housing A has a closed top surface 14 and an open bottom, the latter of which permits the stacking tables D to be moved within housing A to adjust the positions thereof relative to the grabbing means. The bottom of each side of housing A is provided with a pair of inwardly extending brackets 16 which have internally threaded apertures into which externally threaded leveler screws 18 are received. The bottom of each of the screws 18 is supported by a head 20 which rests on the floor. By rotating head 20, the vertical position of housing A with respect to conveyor E can be adjusted. This height adjustment is required to permit the off-loader of the present invention to be utilized in conjunction with a wide variety of different dimension conveyors.

The structure of the grabbing means B is best illustrated in FIGS. 3A, 3B, 4A and 5. Grabbing means B comprises a bracket 22, which has a substantially "U"-shaped configuration when viewed edgewise. Bolted to the bottom leg of bracket 22 is a bottom jaw 24 which extends from bracket 22 towards conveyor E. Jaw 24 is fixedly mounted on bracket 22 and has a substantially "T"-shaped configuration when viewed from above. Affixed to the top surface of jaw 24, at the forward end thereof, is a reflective surface 26, the purpose of which is described below.

Vertically extending from the top surface of the bottom leg of bracket 22 is an upstanding member 28, which is provided with an aperture. Extending through the aperture in upstanding member 28 is a rod or shaft 30. An upstanding member 32 is also provided with an aperture through which shaft 30 extends. In this manner, members 28 and 32 are pivotally connected. Affixed to the upper surface of member 32 is an upper jaw 34 which also has a substantially "T"-shaped configuration when viewed from above. The undersurface of the forward end of jaw 34 has affixed thereto a resilient member 36, preferably made of sponge-like or similar resilient material. Member 36 enhances the grip of the jaws on a part F inserted therebetween, when same are moved to the closed position, as shown in phantom in FIG. 3A. The resiliency of member 36 also permits the jaws to accommodate parts of a variety of different thicknesses, such as those made of different fabrics. The resiliency of member 36, in addition, permits considerable latitude in the closed position of jaw 34 with respect to stationary jaw 24, such that minor changes in the position of jaw 34 with respect to jaw 24 when the jaws are closed do not adversely affect the grabbing operation.

Extending above the surface of jaw 34 is a bracket 38 which is pivotally connected to the piston rod 40 of a pneumatic cylinder 42. Cylinder 42 can be actuated to move piston rod 40 between the position shown in solid in FIG. 3A and the position shown in phantom in FIG. 3A. The effect of this piston rod movement is to move jaw 34 from its open position, as shown in solid in FIG. 3A, to its closed position, as shown in phantom in FIG. 3A. In this manner, cylinder 42 functions to open and close the jaws.

Figure 3A:
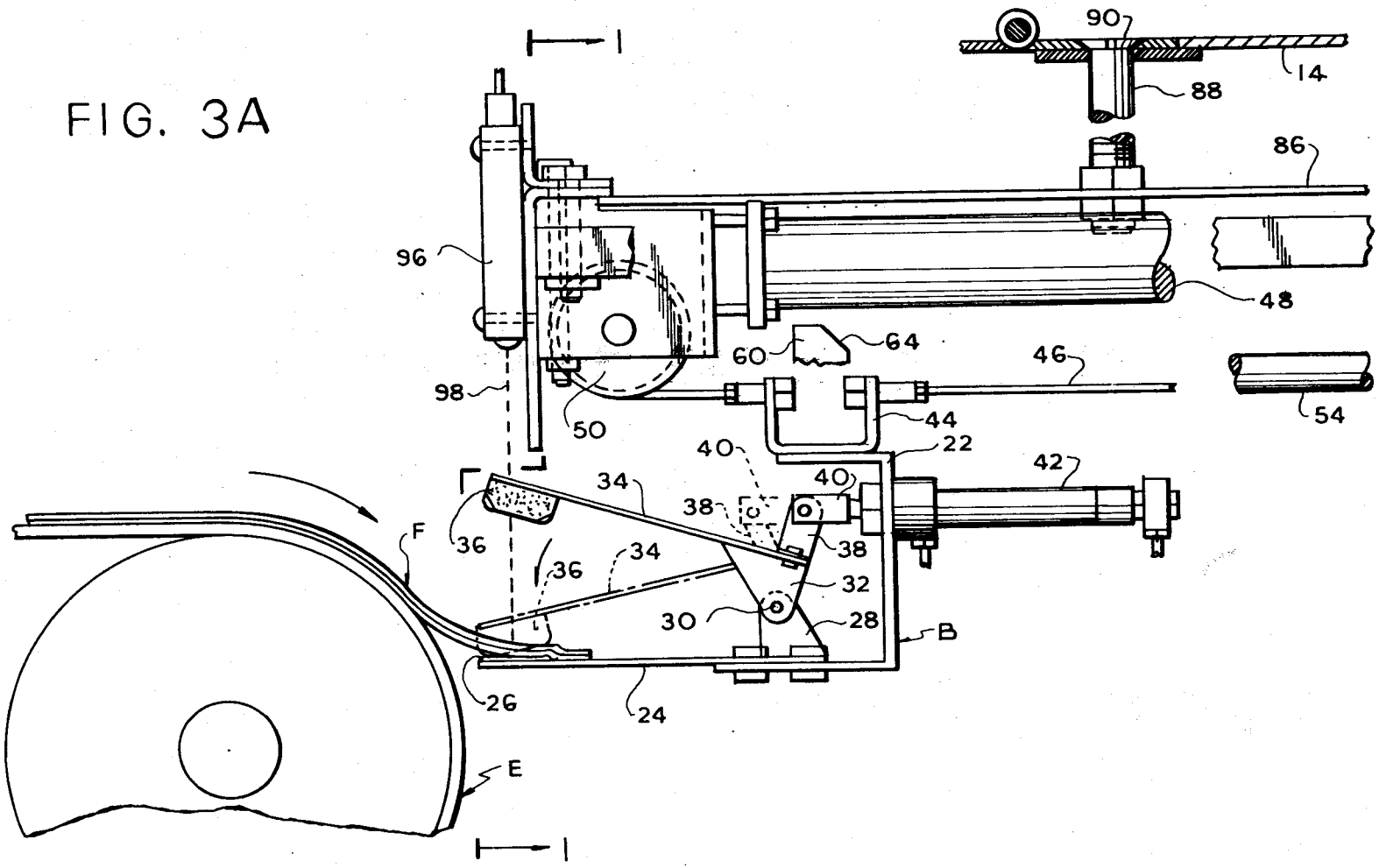
FIGS. 3A and 3B are more detailed side views of the grabbing means, grabbing means moving means and grabbing means mounting means, showing the grabbing means, in sequence, in the first, second and third positions.

Bracket 22 is affixed to the underside of a "U"-shaped bracket 44. Bracket 44 has a pair of upstanding arms, each of which is connected to a different end of a cable 46 in a fashion which permits adjustment of the tension of the cable. Cable 46 forms a portion of a conventional cable cylinder 48 which, in turn, forms a part of the mounting means C. Pneumatic cylinder 48 acts to move cable 46, which is situated around rotatable pullies 50 and 52 located at the front and rear portions, respectively, of the housing, to move grabbing means B from its first position, as shown in FIG. 3A, through its second position, as shown in phantom in FIG. 3B, to its third position, shown in solid in FIG. 3B, and thereafter to return the grabbing means B to its first position.

A pair of guide rods 54, 56 are mounted at the front and rear of the mounting assembly. Guide rods 54, 56 are substantially parallel to each other and to the axis of cable cylinder 48.

Extending from the upper portion of bracket 22 is a guide member consisting of a pair of upstanding portions 60 and 62 (see FIG. 5), each of which has an aperture or bore therethrough into which a different one of the guide rods 54, 56 is received. Guide rods 54, 56 and members 60 and 62 serve to guide the grabbing means along its path of movement. The top surface of member 60 is downwardly inclined towards the rear of the housing to form a cam surface 64. Cam surface 64 is designed to trip a first pneumatic switch valve 66 to cause the jaws to open, when the grabbing means is in the second position, and a second pneumatic switch valve 68, to cause a reversal of the direction of movement of cable cylinder 48, when the grabbing means B reaches the third position.

Figure 3B:
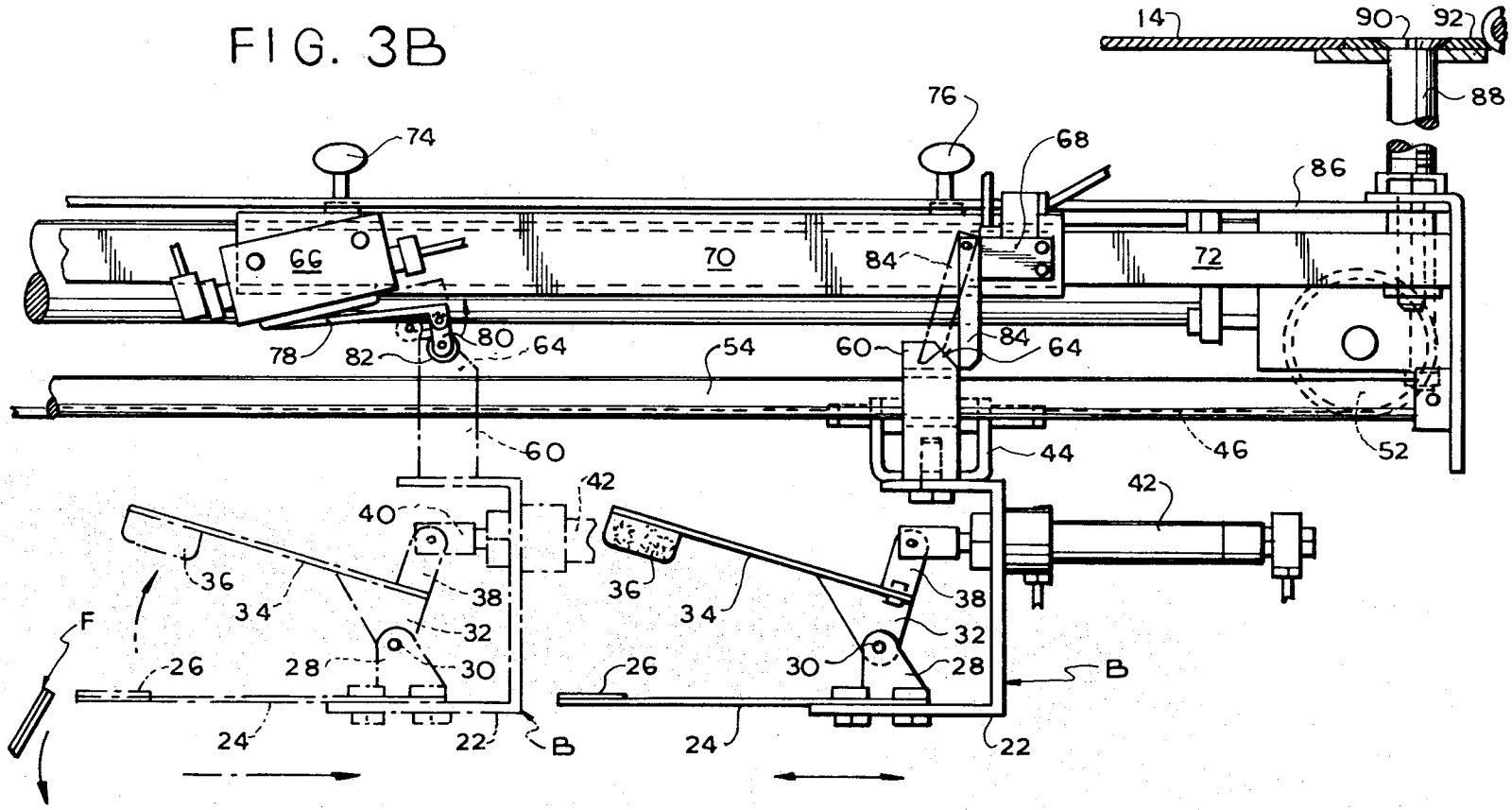
Figure 4A:
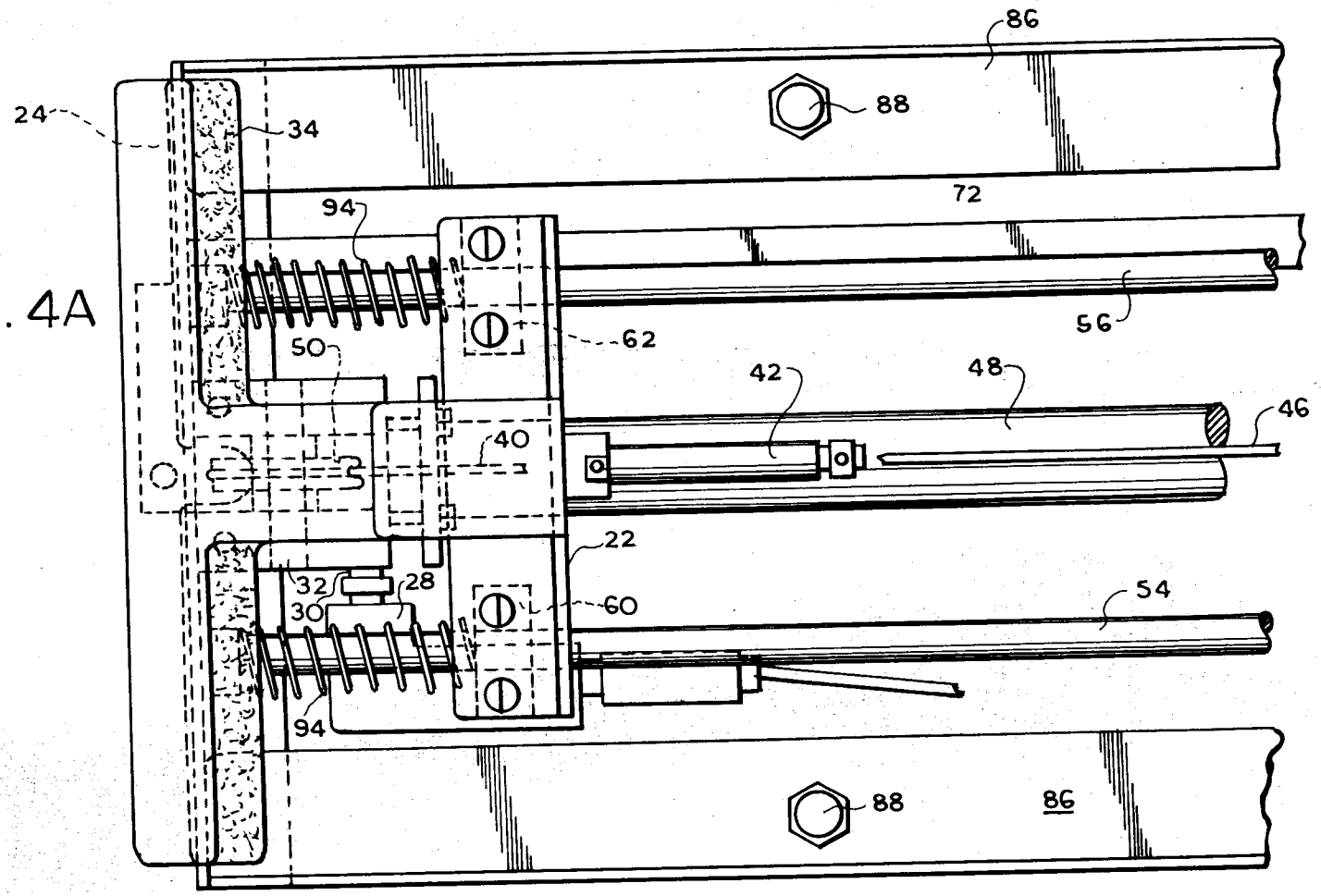
FIGS. 4A and 4B are bottom views of the grabbing means, grabbing means moving means and grabbing means mounting means.
Figure 4B:
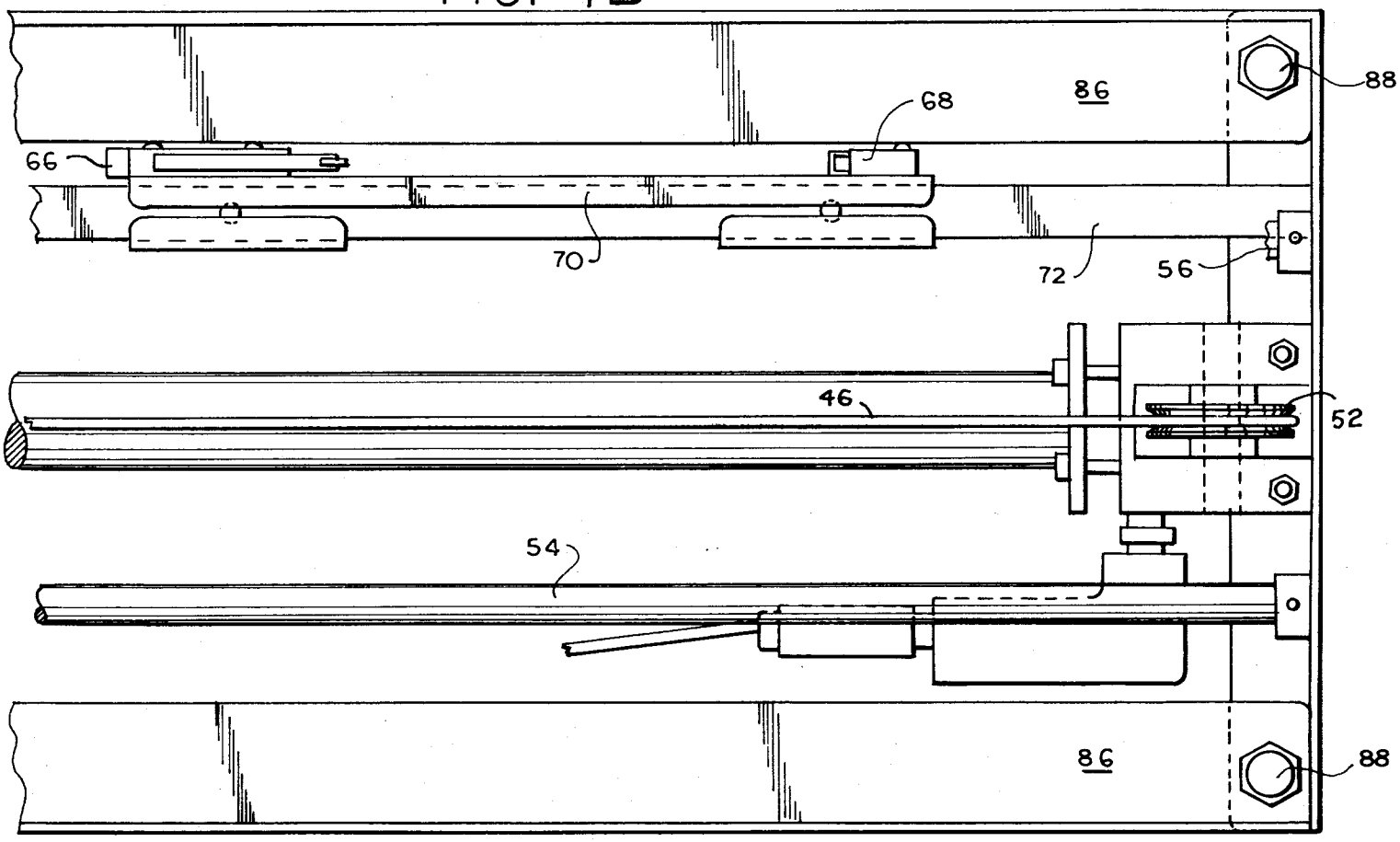

As is best seen in FIGS. 3B and 4B, a position adjustable bracket 70 is affixed to a longitudinally extending support 72. Switches 66 and 68 are mounted within the opposite ends of bracket 70. A pair of threaded screws 74, 76, or the like, extend through openings in the upper surface of bracket 70 into contact with the upper surface of member 72. This configuration permits relative movement between bracket 70 and member 72, when screws 74 and 76 are loosened. Thus, the distance between the second position of the grabbing means, shown in phantom in FIG. 3B, and the first position of the grabbing means, shown in FIG. 3A can be adjusted by simply loosening screws 74 and 76 and moving bracket 70 relative to member 72. The distance between the second and third positions of the grabbing means is also variable, as switch 66 may be moved relative to bracket 70. A set of apertures (not shown) in bracket 70 is provided for this purpose. Screw 74 is inserted through a selected one of the apertures determining the position of switch 66 relative to bracket 70.

Extending from the lower portion of switch 66 is an arm 78 mounted for pivotal movement with respect thereto. Pivotally mounted to the end of arm 78 is a member 80 which carries a cam roller 82. Cam roller 82 is aligned with the path of travel of cam surface 64, such that as grabbing means B moves in the forward direction through its second position, arm 78 is pivoted in a counterclockwise direction to actuate switch 66 to cause the jaws to open. When the grabbing means B is moved in the opposite direction, to return it to the first position, member 80 is pivoted in a clockwise direction relative to arm 78, without causing any pivoting of arm 78, to clear a path for the movement of member 60. In this manner, switch 66 is actuated when grabbing means B is moved through the second position in the forward directed portion of its path of movement, but is not actuated as grabbing means B moves through the second position in the return portion of its path of movement.

Switch 68 is provided with a pivotable trigger 84, normally situated in the position shown in solid on FIG. 3B. However, as member 60 reaches the end of its path of travel, that is, grabbing means B approaches the third position, trigger 84 is moved, by member 60, to a substantially upstanding position, as shown in phantom in FIG. 3B. The movement of trigger 84 actuates switch 68 which causes cable cylinder 48 to reverse its direction, such that grabbing means B is returned from the third position to the first position.

Cable cylinder 48 and all of the associated hardware is mounted on a bracket 86 which is suspended by means of four externally threaded shafts 88 from the undersurface of top 14 of housing A. The distance between bracket 86 and top 14 is adjustable to permit lowering and raising of the mounting assembly relative to housing A. This adjustment is designed to permit the height of grabbing means B to be accurately positioned relative to the conveyor E.

In addition, each of the shafts 88 has a head 90 which is designed to be received within one of a plurality of apertures 92 (see FIG. 1), located along top surface 14 of housing A. Apertures 92 are co-linearly aligned in parallel lines extending in a direction substantially transverse to the path of movement of grabbing means B. In this manner, the mounting assembly C can be mounted on housing A in a position adjustable manner to permit each mounting assembly to be mounted in a position which is aligned with the lane of parts F to be off-loaded. Thus, when only a single lane of parts F is to be off-loaded, the mounting assembly may be mounted towards the center of housing A. However, when two off-loading mechanisms are utilized in side-by-side fashion to accommodate two parallel lanes of parts, off-loading mechanisms are mounted in the positions illustrated in the drawings, such that each is aligned with a separate one of the parallel lanes of parts. Thus, the position of each off-loading mechanism with respect to the housing can be varied in accordance with the intended application.

As best seen in FIG. 4A, each of the guide rods 54, 56 is provided, at its forward end, with a compression spring 94 which abuts the interior surface of the forward end of bracket 86. Springs 94 serve as shock absorbers to dissipate excess kinetic energy from the grabbing means as the grabbing means reaches the end of its return movement at the first position and, in addition, serve to accurately position the grabbing means at the first position.

As best seen in FIG. 3A, the sensing means comprises a scanner, generally designated 96, mounted to the forward portion of bracket 86. Scanner 96 comprises light generating means, in the form of an incandescent bulb or a light emitting diode, and a photo-sensitive signal generating means preferably in the form of a photoelectric cell, or the like. Scanner 96 operates in a conventional fashion. The light generating means generates a beam of light 98 which is directed downwardly, such that same will be reflected by reflective surface 26 on the forward end of jaw 24, when grabbing means B is in the first position. The reflected light beam is reflected upwardly to the photo-sensitive signal generating means, which is also located within scanner 96 immediately adjacent to the light generating means. When grabbing means B is in the first position, the light path from the light source in scanner 96 to reflective surface 26 on jaw 24 and back to the photo-electric cell in scanner 96 is complete.

However, when a part F is inserted between the jaws, as shown in FIG. 3A, the light path or beam 98 is interrupted. The interruption of the light beam causes the photo-sensitive signal generating means to generate an actuation signal to cause the jaws to close, thereby grabbing the part previously inserted therebetween, and cable cylinder 48 to commence moving the grabbing means from the first position towards the second position. The light beam 98 remains interrupted, that is, is not reflected back to sensing means 96, until grabbing means B returns to the first position. At this point in time, the beam is again completed causing the photo-sensitive signal generating means to stop generating the actuating signal, thereby causing the cable cylinder 48 to terminate its movement. The sensing means will actuate the closing means and the movement means when the light beam 98 is again interrupted by the presence of the next part F between jaws 34 and 24. Alternate types of sensing means, such as a micro switch or the like, may be used for transparent or "open" weave objects such as netting.

Figure 5:
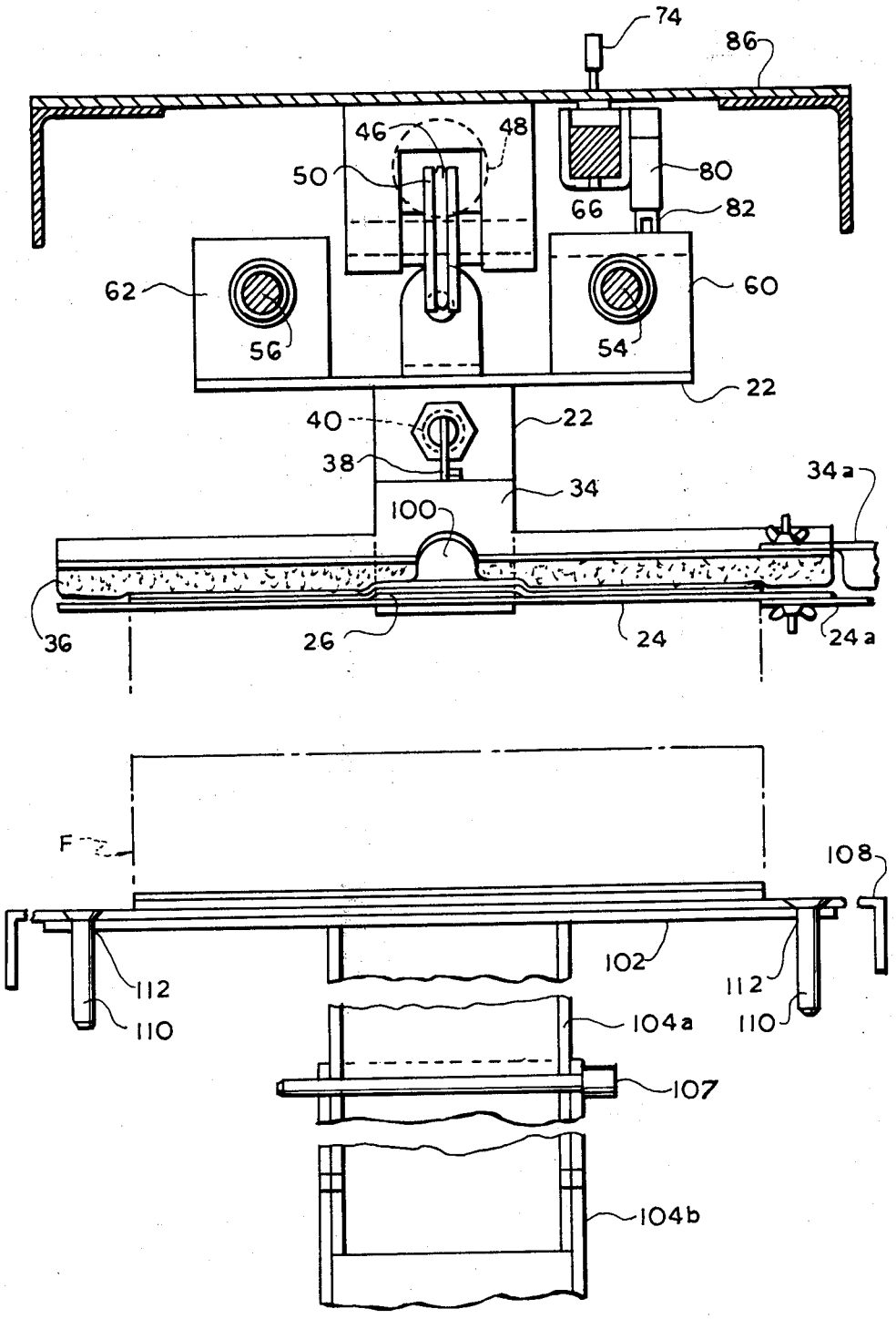
FIG. 5 is a front view of the entrance side of the off-loader of the present invention showing the grabbing means and the stacking surface.

From FIG. 3A, it would appear that jaw 34, even when in the open position, would interrupt the light beam before same reaches the reflective surface 26 on jaw 24. This, of course, would cause a malfunctioning of the mechanism because the light beam could then never be completed to stop the motion of the grabbing means B. In order to prevent this situation, jaw 34 is provided with a cutout or slot 100 (as best seen in FIG. 5), which is aligned with reflective surface 26 on jaw 24. Cutout or slot 100 prevents jaw 34 from interrupting light beam 98 such that the sensing means does not mistake jaw 34 for the presence of a part F inserted between the jaws.

Stacking table D is provided with a stacking surface 102, which has a substantially rectangular configuration, and which is mounted on a telescoping upstanding member 104. Telescoping member 104 is, in turn, mounted on a base member 106. Telescoping member 104 has upper **104*a* and lower 104*b* parts. The vertical position of the upper part 104*a* relative to the lower part 104*b* can be adjusted. In addition, the rotational position of the upper part 104*a* relative to the lower part 104*b* can be adjusted. Such adjustments can be achieved through the use of any conventional position adjusting means, such as a series of openings in the lower part 104*b* which align with groups of openings in the upper part 104*a*, through which a pin 107 or the like can be inserted (see FIG. 5**). The parts can be moved relative to each other by extracting the pin, re-positioning the parts such that the sets of holes are again aligned and re-inserting the pin. In this manner, the effective height of the stacking table and the angular position thereof can be conveniently adjusted.

For certain parts, such as the larger part F shown on the conveyor near the top of FIG. 1, it is preferable to stack same with the length thereof parallel to the longest side of surface 102. However, with other parts, such as the smaller part shown on the conveyor E near the bottom of FIG. 1, it may be preferable to stack same with the length thereof transverse to the longer side of stacking surface 102. It is for this reason, that the parts of upstanding member 104 can be angularly moved with respect to each other, such that either of the stacking tables can be situated with its length either parallel to or transverse to the path of movement of the part.

In addition, in some instances, it is preferable to have a stacking surface which is larger than surface 102. This adjustment is conveniently accomplished by providing a larger stacking surface 108 which is received on top of stacking surface 102 when same is required. To prevent relative movement between stacking surface 108 and stacking surface 102, stacking surface 108 is provided with a plurality of pins 110 designed to be received within openings 112 in surface 102 when surface 108 is placed on top thereof. This configuration is illustrated in FIG. 5.

In certain instances, particularly when parts of long length are stacked, it has been found that the trailing end of the part which hangs from the grabbing means B, as the part is moved by the grabbing means, will contact the uppermost part F on the stack substantially before the leading end is released by the grabbing means. As the part is pulled by the grabbing means, the trailing end thereof may displace the uppermost part on the stack from its desired position. In order to prevent this situation, a temporary support means, in the form of a bar 114, is affixed to the entrance side of the housing by a pair of brackets 116. Bar 114 is situated slightly below the path of movement of grabbing means B at a point a small distance behind the first position thereof. Bar 114 is mounted in a direction substantially transverse to the path of movement of grabbing means B.

The manner in which bar 114 temporarily supports part F as same is moved by grabbing means B is illustrated in FIG. 1. As the leading end of the part F is grabbed by grabbing means B and is moved towards the second position, the trailing end thereof will be pulled off conveyor E and, instead of hanging down, is temporarily supported by bar 114. As grabbing means B continues to move towards the second position, part F is pulled over and off of bar 114. At a time prior to the grabbing means reaching the second position, the trailing end of part F is no longer supported by bar 114 and hangs onto the stack in a position close to its desired final position on the stack. Immediately thereafter, grabbing means B reaches the second position and the leading edge of part F is released. After the leading edge of part F is released, same falls onto the stacking table. In this manner, there is little or no relative movement between the part on the top of the stack and the part being stacked, when the parts are in contact. Thus, the part being stacked cannot move the part on the top of the stack from its desired position.

It should be noted that the present invention has been illustrated as being adapted to off-load parts which comprise a strip of one or several fused layers of fabric such as a man's coat front, pocket flap, or the like. However, the configuration of the parts as shown on the drawings are disclosed herein for illustrative purposes only and it should be understood that the off-loader of the present invention can be utilized with a variety of different size, shape, fabric, style and type parts, as will be readily appreciated by those skilled in the art.

Certain manufacturing operations will employ variable numbers of lanes of parts. For instance, four lanes of parts may be moved simultaneously along a conveyor if the parts are relatively narrow. In order to stack parts from four lanes, four off-loader mechanisms are mounted to the enclosure, one for each lane. However, the same manufacturer, at other times, may off-load from only two lanes, because the parts are wider and only two lanes can be used without changing the conveyor.

In order to permit this, a switch is provided to cut off the air supply to the two center lanes. The jaws associated with the two center lanes are then moved to their respective third positions and extension members 24*a* and 34*a* are fastened onto the sides of jaws 24 and 34, as is illustrated in FIG. 5, to extend same to firmly grab the wider parts. Moving the jaws associated with the center lanes prevents same from interfering with the movement of the operative jaws.

Extension members 24*a* and 34*a* may each be provided with a slot. The slot is fastened to the jaws in any convenient manner, such as by using a threaded screw extending from the outer surface at each end of each jaw. A wing nut or the like is used to clamp the extension to the jaw.

Figure 6:
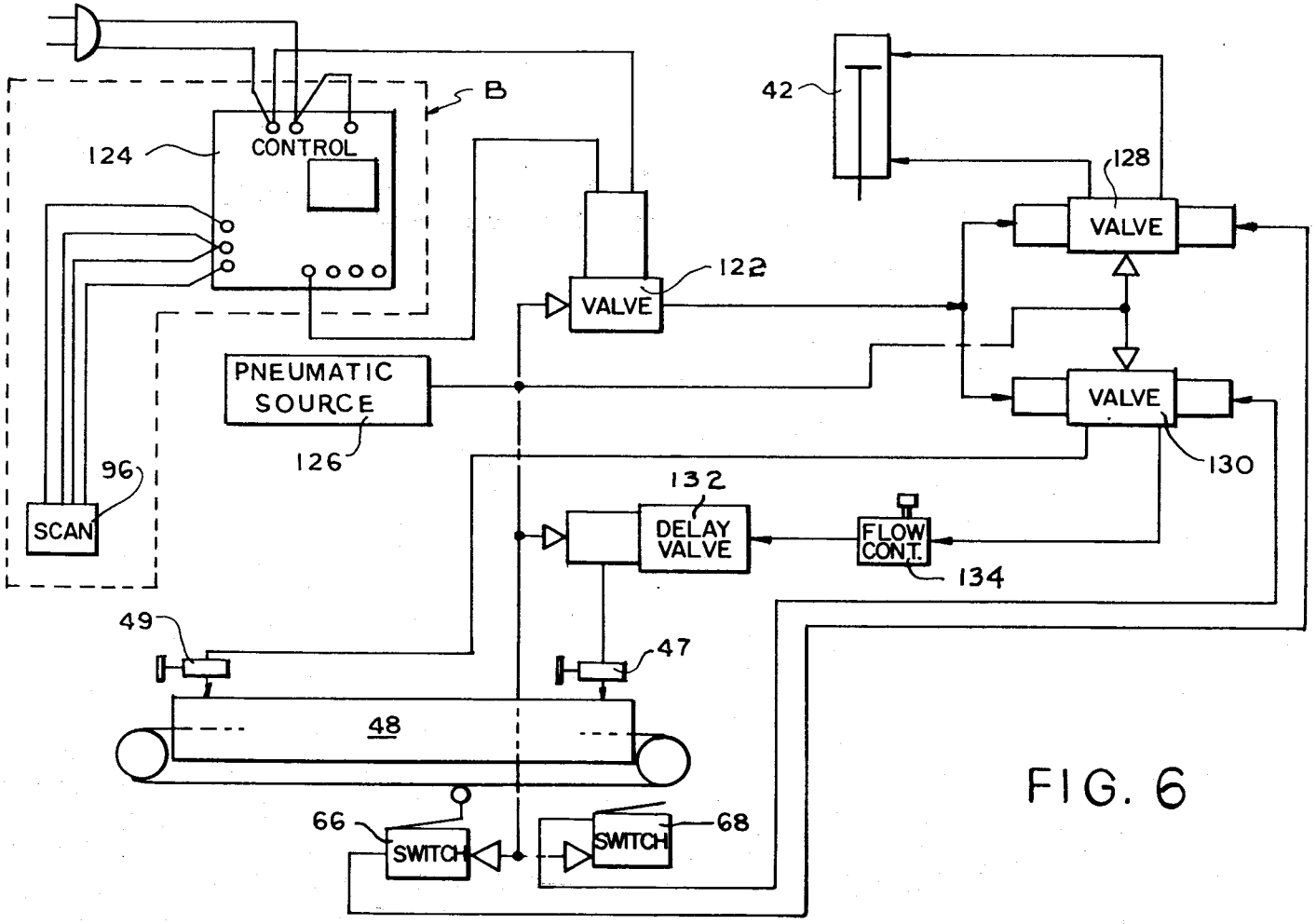
FIG. 6 is a schematic diagram of the pneumatic and electrical connections of the off-loader of the present invention.

FIG. 6 shows a schematic diagram of the pneumatic system of the present invention. Plug 120, designed to be plugged into a 110 v. A.C. outlet, provides power to the sensing means B and an electrically energized solenoid valve 122. Sensing means B is a BEC-1 photo-electric control or the like comprising a SP 510 photo-electric scanner 96, or the like, and associated circuitry 124, including a BR2-6 relay which controls the electrical energization of valve 122. Valve 122 is energized when the scanner 96 detects the presence of a part between the jaws.

Valve 122 is connected to a source 126 of compressed air and when energized, pneumatically actuates pneumatic valves 128 and 130, each of which is also connected to air source 126. Valve 128 controls jaw closing cylinder 42. Valve 130 controls cable cylinder 48. When actuated by valve 122, valve 128 causes cylinder 42 to close the jaws and valve 130 causes cable cylinder 48 to move in the forward direction.

Valves 128 and 130 are also respectively pneumatically actuated by pneumatic switches 66 and 68. Switches 66 and 68 are also each connected to air source 126. When actuated by switch 66 (indicating grabbing means B is in the second position), valve 128 causes cylinder 42 to open the jaws. When actuated by switch 68 (indicating grabbing means B in the third position), valve 130 causes cylinder 48 to move in the reverse direction. Flow control valves 47, 49 to control the speed of cylinder 48 are interposed between valve 130 and the forward and reverse sides of cylinder 48. When scanner 96 senses grabbing means B in the first position, valve 122 is turned off, turning off valve 128 to keep the jaws open and valve 130 to keep the grabbing means in the first position until the next piece is sensed.

Interposed between valve 130 and the forward side of cable cylinder 48 is a delay valve 132 connected to air source 126 and a flow control 134, such as FABCO FC032 or the like. Valve 132 can be set to delay the forward movement of cylinder 48 for a time interval (0–10 seconds) determined by adjustable control 134. This permits the jaws to close but the forward motion of cylinder 48 to be delayed. A delay between jaw closing and jaw movement is required when extra long parts, longer than conveyor E, are stacked. A part longer than the conveyor will have its trailing end in the work station feeding the conveyor when the leading end is in the jaws. If the jaws are moved, the part will slip out. In order to avoid this, a delay of jaw movement is used to prevent movement of the jaws before the trailing end is free from the processing station feeding to conveyor E.

It will now be appreciated that the present invention is an off-loader which has sufficient versatility to permit widespread application in the clothing and softgoods industries. The mechanism is adjustable such that it can be utilized with parts of a variety of different sizes, shapes and fabrics. In addition, the mechanism is adjustable such that it can be utilized in conjunction with a wide variety of conveyors of different dimensions and can be modified to simultaneously accommodate variable numbers of parallel lanes of parts on the same or adjacent conveyors. The present invention also permits stacking of parts on interchangeable surfaces of different dimensions.

The off-loader is designed to permit inexpensive modification to meet the needs of a particular purchaser. In addition, the off-loader can be adjusted by the purchaser, in a quick and easy fashion, to accommodate his specific but changing needs. The mechanism consists of relatively simple parts which function reliably together and is relatively inexpensive to manufacture, modify and maintain.

While only a single preferred embodiment of the present invention has been disclosed for purposes of illustration, it is obvious that many modifications and variations can be made thereto. It is intended to cover all of these variations and modifications which fall within the scope of the present invention, as defined by the following claims:

I claim:

1. Apparatus for off-loading a part from a conveyor or the like comprising: a support; part grabbing means; means for moving said grabbing means relative to said support, from a first position, wherein said grabbing means grabs the part, through a second position, defined by means for causing said grabbing means to release the part, to a third position, defined by means for causing said moving means to reverse direction; means for mounting said release causing means in a fixed position relative to said reversal causing means, said mounting means being adjustably movably mounted on said support to permit adjustment of the distance between said first and second positions.

2. The apparatus of claim 1, wherein said moving means comprises an assembly comprising guide means and a cylinder, operatively connected to said grabbing means for moving said grabbing means along said guide means and means for adjusting the position of said assembly relative to said support.

3. The apparatus of claim 1, further comprising a stacking surface upon which the part is placed, and means for adjusting the angular position of said surface in a plane parallel to the plane of movement of said grabbing means.

4. The apparatus of claim 3, wherein said means for adjusting the angular position of said surface adjusts same relative to the direction of said grabbing means movement.

5. The apparatus of claim 1, wherein said moving means comprises an assembly comprising guide means and a cylinder operatively connected to said grabbing means for moving said grabbing means along said guide means and further comprising means for adjusting the position of said assembly relative to the undersurface of said support.

6. The apparatus of claim 1, further comprising means for adjusting the position of said support relative to the conveyor.

7. The apparatus of claim 1, further comprising delay means associated with said moving means for delaying the actuation of said moving means for a predetermined time interval after said light path is interrupted by the part.

8. The apparatus of claim 1, wherein said support comprises an enclosure and wherein said enclosure comprises a variable number of modular sections.

9. The apparatus of claim 1, wherein said grabbing means comprises a pair of normally open jaws and further comprising part sensing means, said sensing means comprising light generating means and photo-sensitive signal generating means located on said support and light reflecting means located on one of said jaws, and means on said other of said jaws for preventing interruption of the light path between said light generating means, said light reflecting means and said photo-sensitive means, when said jaws are open.

10. Apparatus for off-loading parts from a first surface and stacking same on a second surface, said apparatus comprising: a support adapted to be located adjacent the first surface; means effective, when actuated, to grab a part situated on the first surface; means for mounting said grabbing means to said support; means for moving said grabbing means along said support relative to the surface between a first position, wherein said grabbing means is situated to grab the part, a second position, wherein at least a portion of the part is aligned with the second surface and a third position, spaced from said second position in the direction of movement of said grabbing means from said first position to said second position; means for sensing the presence of the part at said first position; means, responsive to said sensing means, for actuating said grabbing means to grab the part and said moving means to move said grabbing means from said first position, through said second position, to said third position; means, located at said second position, responsive to the movement of said grabbing means for causing said grabbing means to release said part when said grabbing means is in said second position, said third position being defined by means for causing said moving means to reverse direction, and means for mounting said release causing means in a fixed position relative to said reversal causing means, said mounting means being adjustably movably mounted on said support to permit adjustment of the distance between said first and said second positions.

11. The apparatus of claim 10, wherein said grabbing means comprises a pair of normally open jaws and wherein said sensing means comprises light generating means and photo-sensitive signal generating means located on said support and light reflecting means located on one of said jaws and further comprising means on said other of said jaws for preventing interruption of the light path between said light generating means, said light reflecting means and said photo-sensitive means by said other jaw, when said jaws are open.

12. The apparatus of claim 10, further comprising delay means associated with said moving means and adapted to delay actuation of said moving means for a preset time interval.

13. The apparatus of claim 10, wherein said support comprises an enclosure and wherein said enclosure comprises a variable number of modular sections.

* * * * *